United States Patent [19]

Bussard

[11] Patent Number: 4,852,483

[45] Date of Patent: Aug. 1, 1989

[54] KIT FOR INDIVIDUALIZED SILK SCREEN PRINTING

[76] Inventor: Janice W. Bussard, 201 N. Fruitport Rd., Spring Lake, Mich. 49456

[21] Appl. No.: 195,598

[22] Filed: May 18, 1988

[51] Int. Cl.[4] ..... B41F 15/02

[52] U.S. Cl. ..... 101/128; 101/114; 33/564

[58] Field of Search ..... 101/128, 112, 114, 127, 101/127.1; 33/564

[56] References Cited

U.S. PATENT DOCUMENTS

| | | | |
|---|---|---|---|
| 2,451,775 | 10/1948 | Roher | 101/128 |
| 2,520,567 | 8/1950 | Schleif | 101/128 |
| 3,584,385 | 6/1971 | Booth | 101/128 X |
| 3,624,944 | 12/1971 | Blomqvist | 101/128 X |

FOREIGN PATENT DOCUMENTS

| | | | |
|---|---|---|---|
| 152094 | 11/1981 | German Democratic Rep. | 101/128 |
| 136901 | 8/1952 | Sweden | 101/127 |
| 1364 | of 1864 | United Kingdom | 101/128 |

*Primary Examiner*—Clifford D. Crowder

[57] ABSTRACT

A kit for singular screen printing on T-shirts, including a carrier loaded with a row of overlapping stencils and a mask for shielding around a printing area.

11 Claims, 5 Drawing Sheets

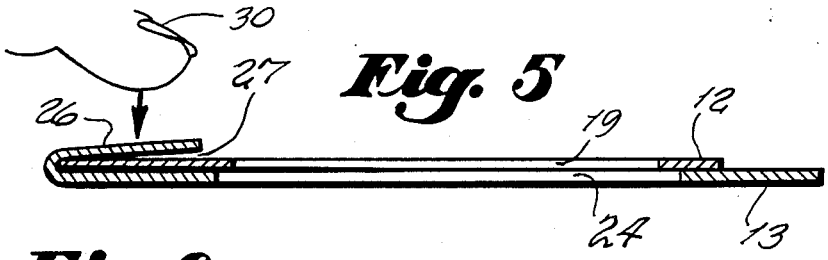
Fig. 5
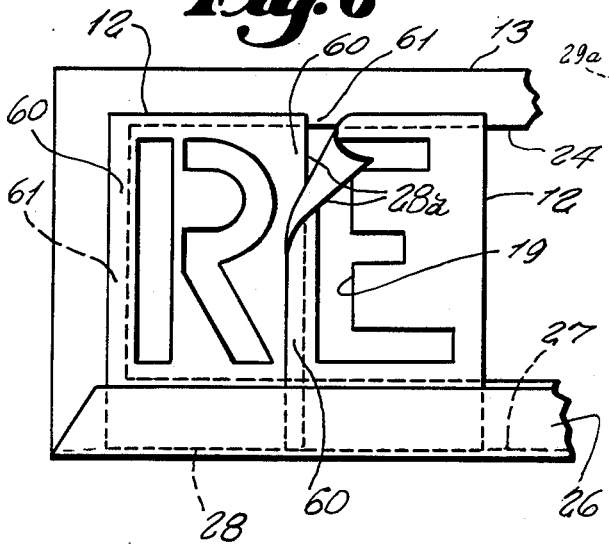
Fig. 6
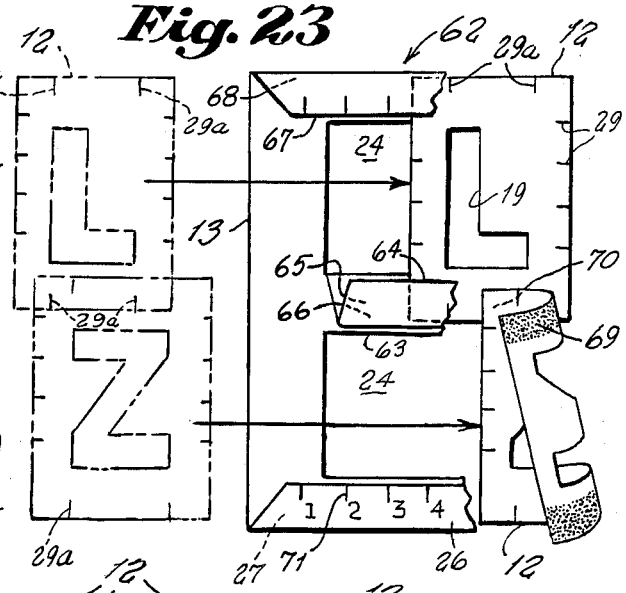
Fig. 23
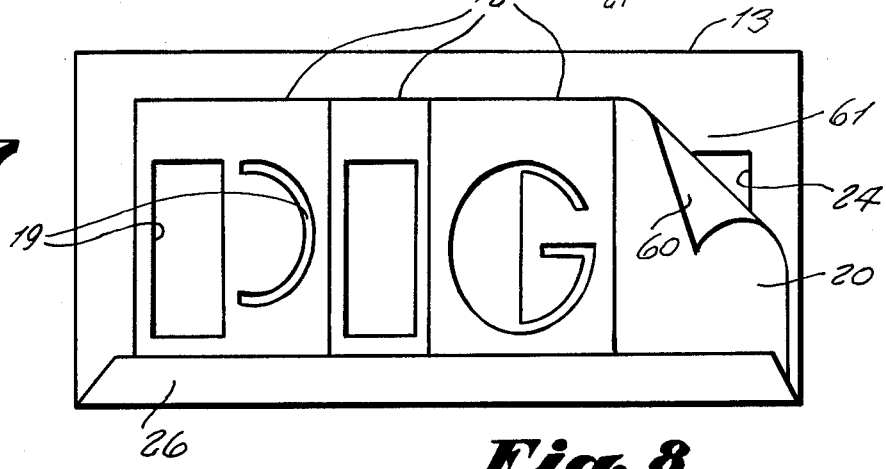
Fig. 7
Fig. 8
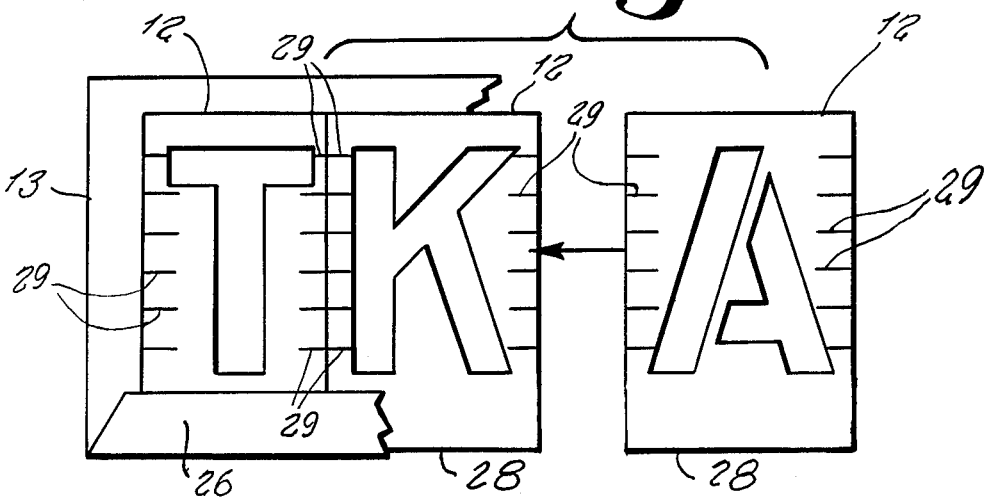

Fig. 9
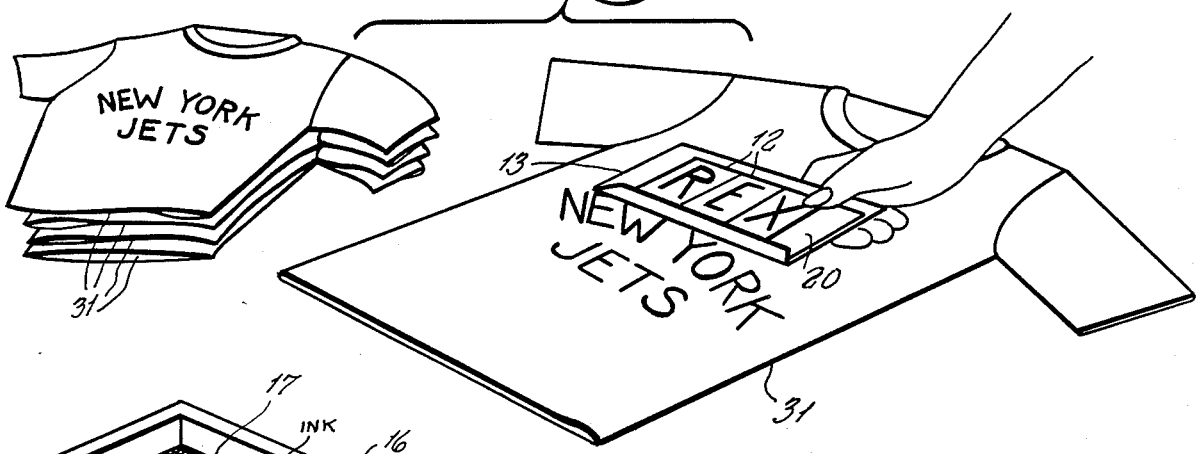
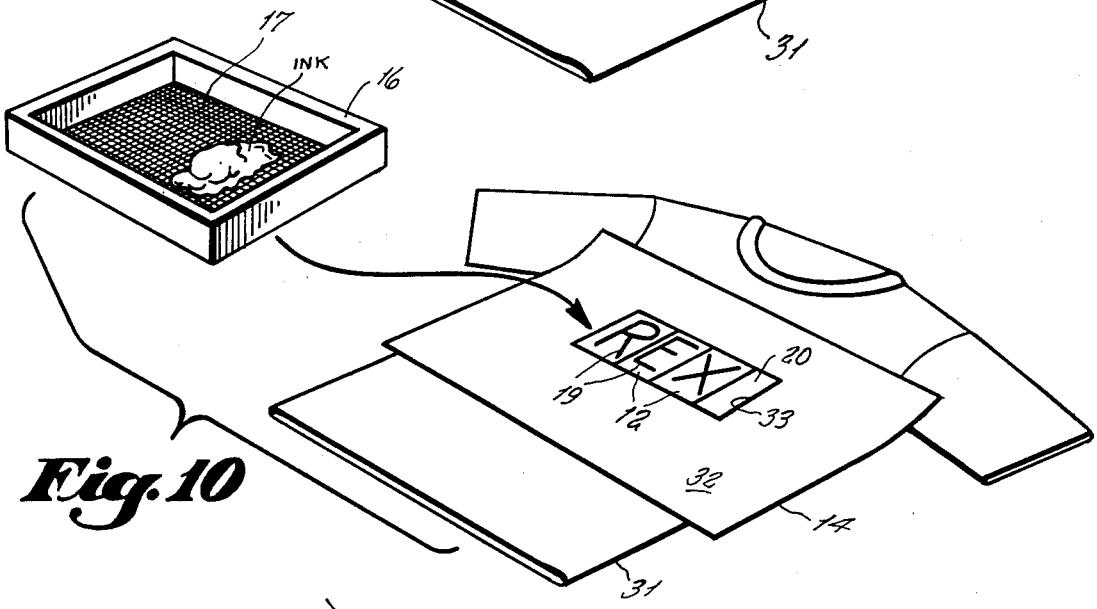
Fig. 10
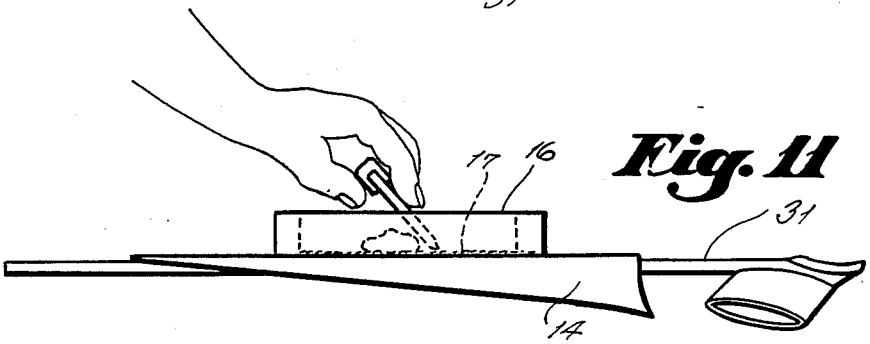
Fig. 11
Fig. 12
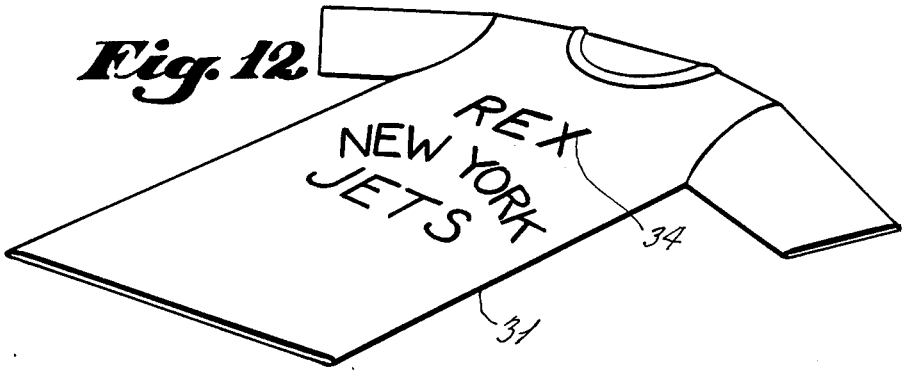

Fig. 13
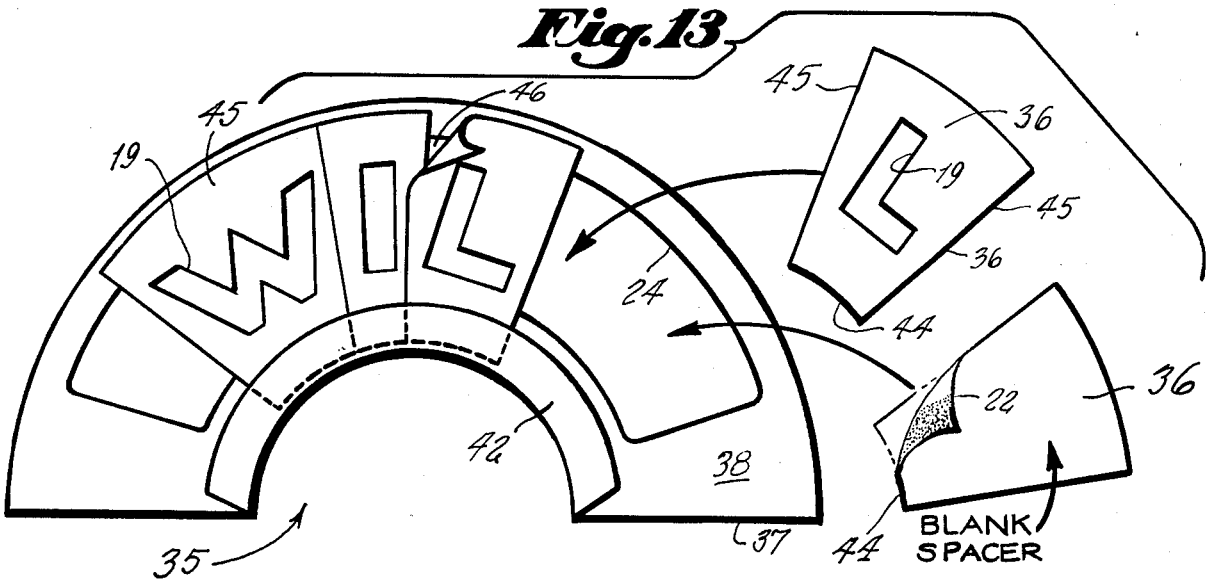
Fig. 14
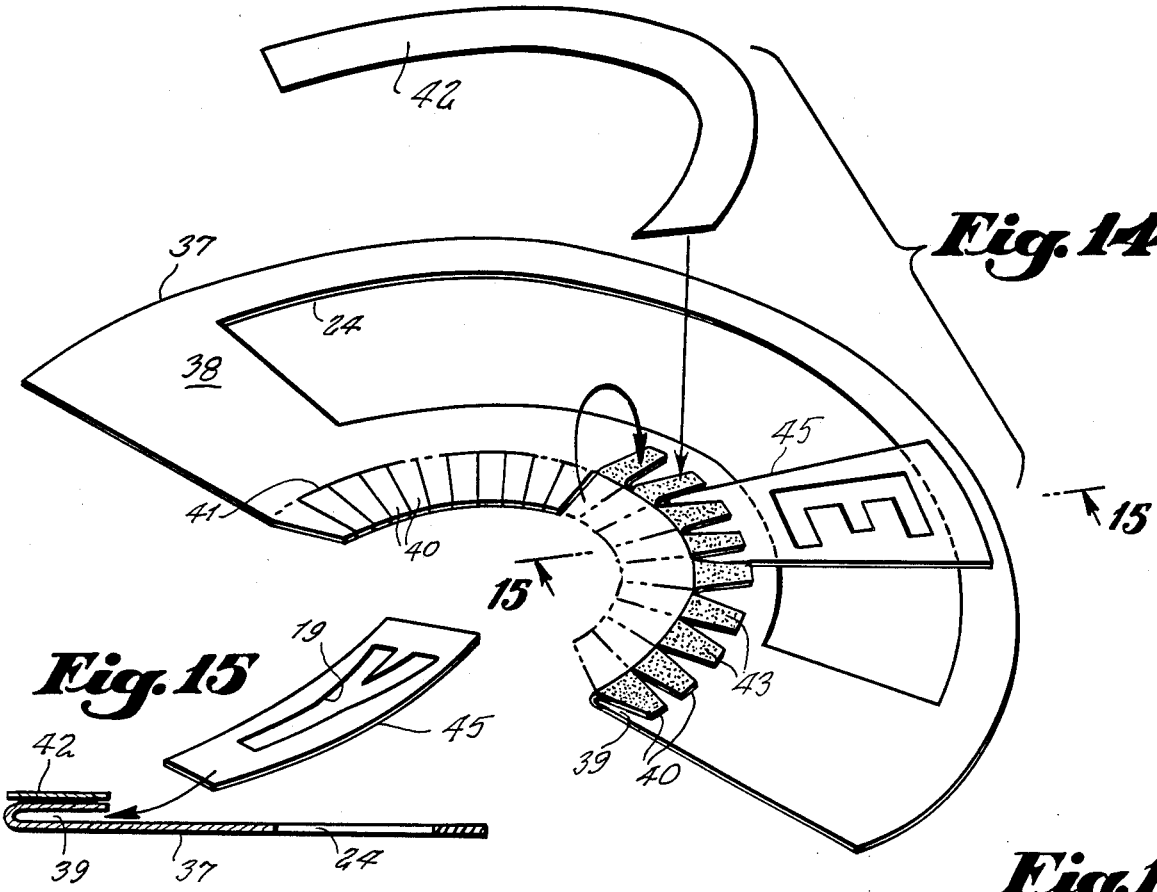
Fig. 15
Fig. 16
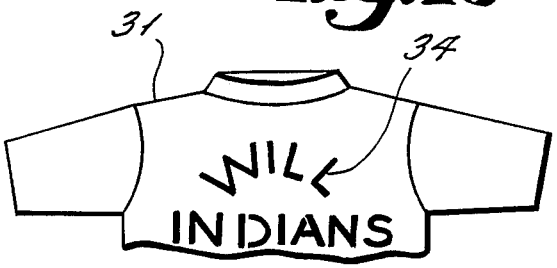
Fig. 17
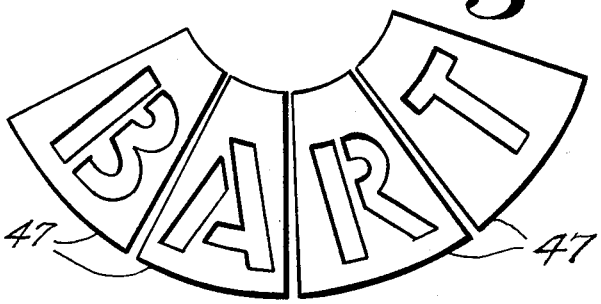

KIT FOR INDIVIDUALIZED SILK SCREEN PRINTING

BACKGROUND OF THE INVENTION

1. Field of the Invention

This invention relates generally to a silk screen printing process upon textiles or other materials wherein a paste-like ink is squeezed through a screen mesh and interposed stencil upon the material so to print an image there-upon. While this process is suitable for printing on all manner of different products (such as furniture and fixtures, clothing and accessories, flags and banners, posters and other signage, etc.) for use in different environments to include the home, school, church, workplace, or recreational area, it is used especially for numerous decorations applied to T-shirts that are popular today as comfortable wearing apparel by many individuals representing all age groups.

2. Prior Art

T-shirts are acceptable wearing apparel for many everyday activities such as in workplaces and recreational areas, as well as in numerous competitive sports between individual players or teams wherein each team has its name printed thereupon, so to visually distinguish teams from each other or their opponents. The silk screen printing of a team's name on multiple shirts is accordingly done in a mass production manner. However, many teams additionally identify each individual player by a number, the individual's surname/given name, a particular logo or other imagery which is also printed on the T-shirt. This is accomplished with die-cut heat transferred letters, individual numerals, and the like or with the preparation of an individualized silk screen for printing of the same upon each T-shirt.

Such heat transfers are not long-lasting and durable while customized preparation of silk screens and their subsequent limited use is costly and time-consuming not only to prepare but to set up, print, and clean up as well; therefore, the process is in need of an improvement.

SUMMARY OF THE INVENTION

Accordingly, it is a principal object of the present invention to provide a kit for individualized printing on a T-shirt or the like by using a silk screening process which is accomplished in a fast and efficient manner with accurate results while providing disposable components for promoting a time-saving cleanup procedure.

Another object is to provide a kit for individualized silk screen printing for the general public which requires no particular aptitude, skill, or previous experience while achieving expert and professional results.

Yet another object is to provide a kit for individualized silk screen printing that is cost effective requiring a printer's standard machinery and supplies without a need for further capital outlay for expensive sophisticated equipment.

These and other objects will be readily evident upon a study of the following specification and the accompanying drawings.

BRIEF DESCRIPTION OF THE DRAWING FIGURES

FIG. 4 is a similar perspective view showing additional stencils being placed into the carrier while slightly overlapped so as to form an assembled word or the like.

FIG. 5 is an enlarged cross-sectional view taken on line 5-5 of FIG. 4.

FIG. 6 is a fragmentary front view of the assembled carrier and stencils shown in FIG. 4.

FIG. 7 is a view similar to FIG. 6, and showing the use of a different style of alphabetical stencil characters with the unused carrier space at the end masked off.

FIG. 8 is a view similar to FIG. 6 and showing yet another design of stencils which includes printed calibrations for precise stencil alignment on a carrier.

FIG. 9 is a perspective view of the assembled stencils and carrier shown placed upon a T-shirt prior to a printing process.

FIG. 10 is a similar view showing a subsequent step wherein one of the protective shields (shown in FIG. 1) is placed over the assembled carrier and stencils prior to printing.

FIG. 11 is a side-elevational view showing the printing operation, which follows the steps illustrated in FIGS. 1 through 10.

FIG. 12 is a perspective view of a T-shirt shown after being printed by the operation illustrated in FIG. 10.

FIG. 13 is a view similar to FIG. 4 and showing a modified design thereof for printing characters along an upwardly arched line instead along a straight line.

FIG. 14 is an exploded perspective view illustrating successive steps in the manufacture of the curved or arched carrier shown in FIG. 13.

FIG. 15 is a cross-sectional view taken on line 15—15 of FIG. 14 and showing a stencil being fitted into the carrier.

FIG. 16 is a front view of a T-shirt showing a completed printed name thereupon by the kit assembly illustrated in FIG. 13.

FIG. 17 is a front view of another design of stencils for printing characters along an inverted arch or downwardly curve.

FIG. 23 is a fragmentary front view of yet another design of carrier for supporting two rows of stencils.

DETAILED DESCRIPTION OF PREFERRED EMBODIMENTS

Figure 1:
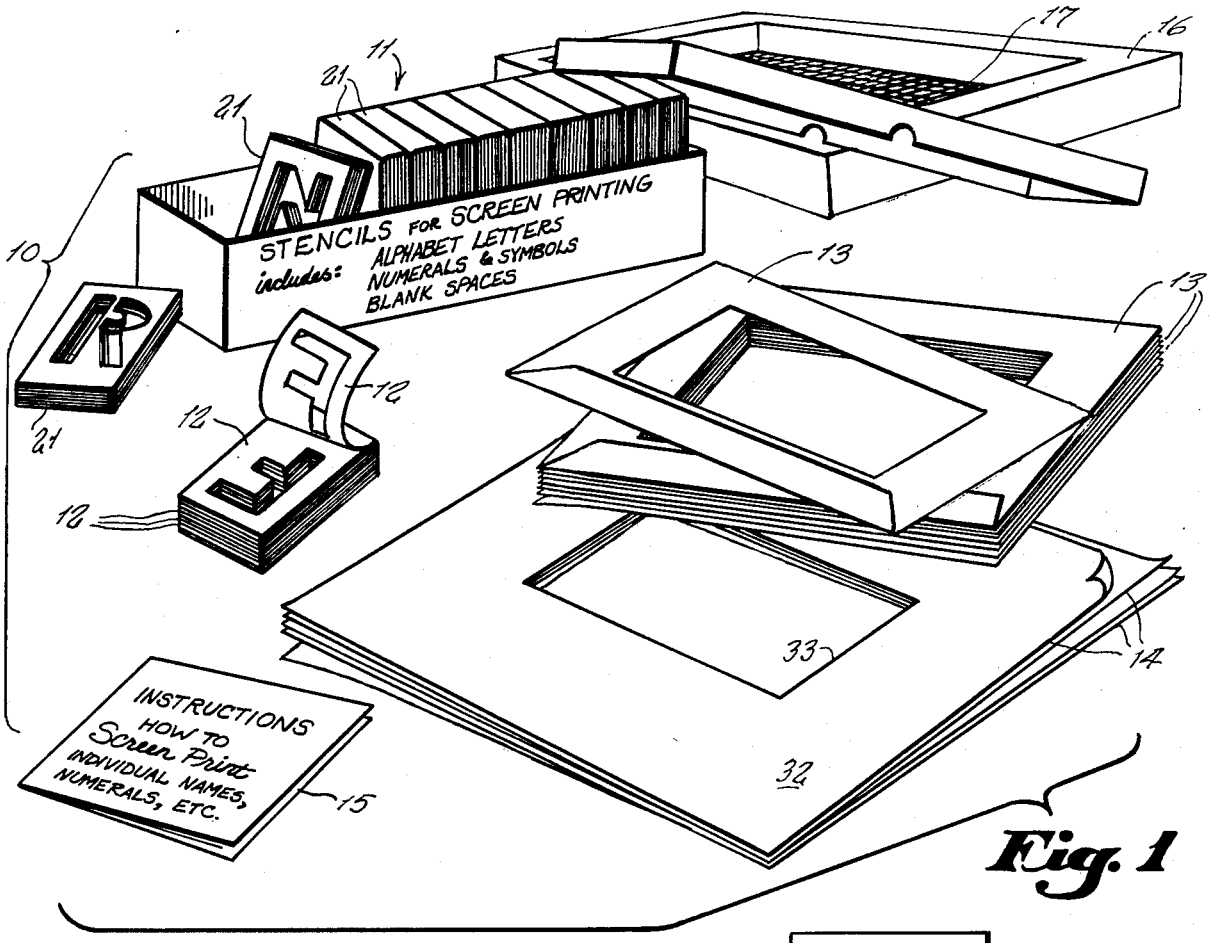
FIG. 1 is a perspective view of a kit comprising components of the present invention.
Figure 2:
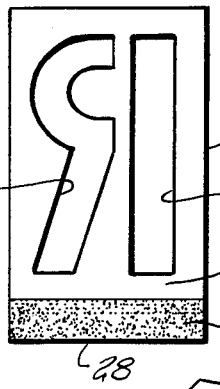
FIG. 2 is a rear view of one of a paper stencil torn off a stencil pad or packet exhibiting a self-adhesive material on one end as shown in FIG. 1.

Referring now to the drawings in greater detail, and more particularly to FIGS. 1 through 12 thereof at this time, the reference numeral 10 represents a kit according to the present invention wherein there is a font 11 of printing stencils 12, a plurality of stencil carriers 13, a plurality of masks 14 and an instructional booklet 15. As shown in FIG. 1, a printer frame 16 fitted with screen mesh 17 may be included in the kit along with other printing accessories (not shown) such as, ink and a squeegee so that any T-shirt retailer or other person without professional help will be able to print a name, word, number or other imagery successfully on a T-shirt or other textile products for personal use or that of a customer.

Each stencil comprises a rectangular sheet of paper 18 having a central cutout 19 of either an alphabetical character, a numeral, a symbol or other imagery. Otherwise it may have no cutout at all so as to serve as a blank spacer 20. The stencils are assembled together into pads 21; every stencil in a pad having a same cutout representation. The stencils are held together on the pad by a pressure sensitive adhesive 22 along a lower end of each stencil's rear side, and they may be peeled off the pad, one at a time, as needed.

Figure 4:
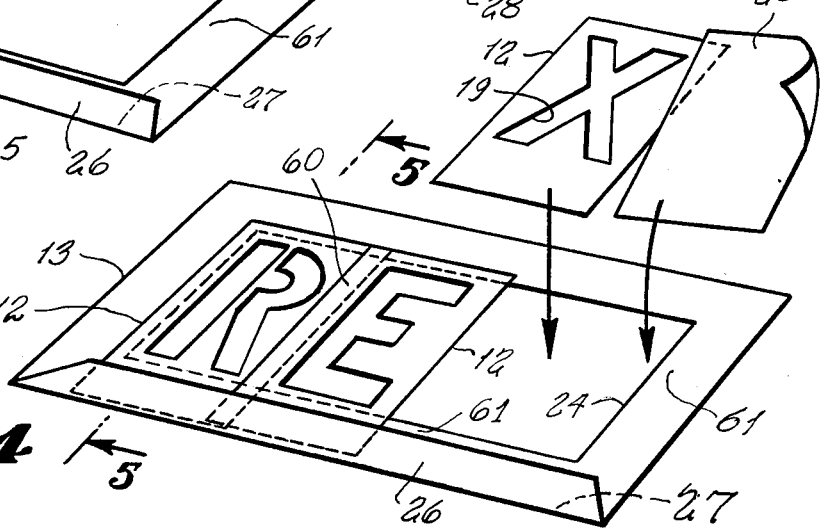

Each of the stencil carriers are likewise made from a rectangular sheet of paper 23 having a central rectangular die-cut opening 24. One longitudinal edge of the paper is folded over a straight fold line 25 so as to form a tab 26 creating a pocket 27 into which a lower end of the stencils will be inserted when in use. It is to be noted that the fold line is parallel to the longitudinal axis of the opening 24 and a specific distance therefrom. Also the stencil cutout 19 is a precise distance from the stencil lower edge 28, so that when the stencils are inserted all the way to the bottom of the pocket, all the stencil cutouts align precisely along a straight line as best shown in FIGS. 4 and 6. The opening 24 is wider in height than the height of the cutout 19 so that a stencil open area is fully clear of the opening edges.

In order to accomodate the wish for larger or smaller letters or numerals in different styles being printed on a T-shirt, a different kit or its disposable components will be provided for each size and style desired as shown in FIG. 7. The width of the stencils and spacers may vary from wide to narrow, as shown, to allow for appropriate and uniform spacing between printed letters suuch as "i" or "w."

As best shown in FIGS. 4 and 6, each stencil includes an area 60 along each opposite side edge thereof that extends from the stencil side edge 28a to the cutout 19. This edge area has an equally same uniform width on all of the stencils so that stencils may be overlapped a uniform maximum amount providing automatic equal spacing between letters or numerals while preventing ink seepage therebetween during a printing operation as well as any stencil edge to overlap and block out a portion of a neighboring stencil cutout. As also shown, a similar overlapping occurs between all edge areas 61 of the carrier opening and the edges of the stencils for a same reason.

FIG. 8 shows another design of stencil 12 which additionally includes printed calibrations 29 along each side edge for aligning with calibrations of adjacent stencils for readily indicating if the stencils are precisely aligned without need to lift up the tab so to check.

Figure 3:
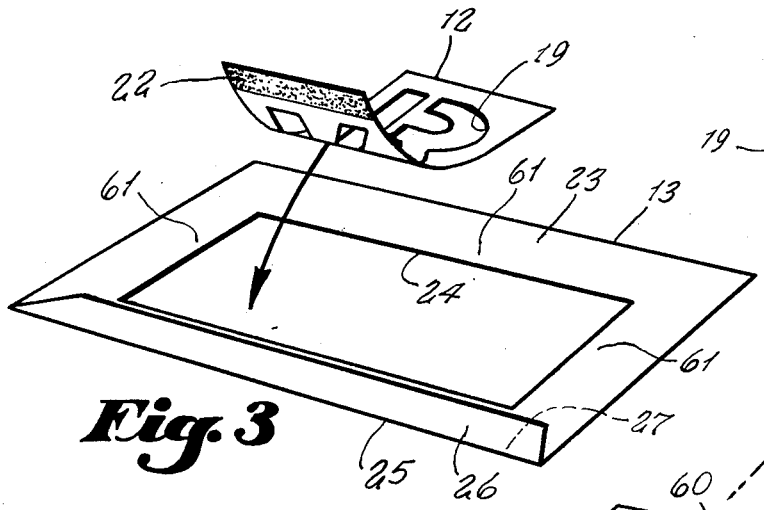
FIG. 3 is a perspective view of the stencil placed into one of the stencil carriers shown in FIG. 1.

In operative use of the invention, a T-shirt is properly positioned on the platen. The stencils for composing a word or number are taken from the kit and then placed into a carrier, as shown in FIG. 3. The lower ends of the stencils having the pressure sensitive adhesive are inserted into the pocket's lower edge and positioned to overlap each other as well as the opposite side ends of the opening 24, so as to prevent the ink seepage, as mentioned. If the stencils selected for the printing job do not cover the entire opening, then blank spacers 20 must be added to fill the left over portion of the opening, as also shown in these figures. The tab 26 is then pressed down by a finger 30 so to adhere the stencil firmly to the carrier in proper position.

As shown in FIG. 9, the assembled carrier with its stencils is then placed upon the T-shirt 31, front side up. After this, one of the masks 14 is placed over the assembly, as shown in Figure 10 to protect adjacent areas of the T-shirt from any ink smudges during the printing process. The mask comprises a large sheet of paper 32 having a die-cut opening 33 that is a same size as opening 24 in order to leave only the stencil cutouts exposed. Following this, the screen printing frame 16 is placed thereupon as indicated in FIG. 11. The shirt is then printed individually with the name 34 as shown in FIG. 12.

The foregoing description is only for screen printing letters or numerals along a straight line. However, sometimes the printer is ordered to print the same along an upwardly arched line instead. This is accomplished by a kit 35 shown in FIG. 13 wherein the above described stencils and carrier are substituted by stencils 36 and a carrier 37.

The carrier 37, made of a die-cut paper sheet 38, has a curved pocket 39 formed by tabs 40 folded over a curved fold line 41. The tabs are retained in folded-over position by means of a paper strip 42 adhered thereto by adhesive 43 applied to the underside of the tabs before being upwardly folded over, as shown.

The stencils 36 are shaped with a curved bottom edge 44 so to seat precisely against the bottom of the pocket, and upwardly diverging side edges 45 serve to overlap and fill the spaces 46 between the stencils so to prevent ink seepage therebetween.

Otherwise the stencils and carrier include the same features of the previously described design, including the stencil adhesive 22 and the carrier opening 24.

The kit 35 may be made to additionally include another set of stencils 47, shown in FIG. 17, so as to print letters or numbers along a downwardly inverted arch or curve while using the same carrier 37 turned around so that the pocket is at a top. In this design the stencils are die-cut with the cutouts turned halfway around so that the top of a letter or numeral are toward the narrower end of the stencil having the adhesive 22 on its rear.

Figure 18:
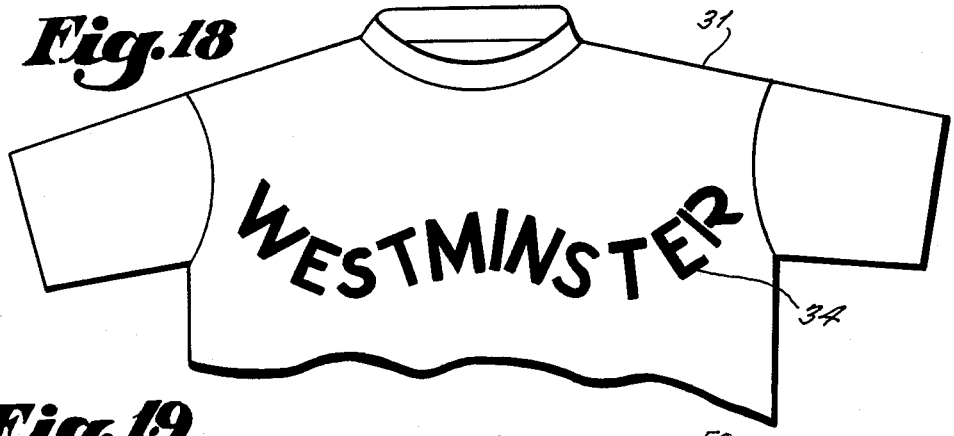
FIG. 18 is a front view of a T-shirt showing a name printed along downwardly and upwardly curves.
Figure 19:
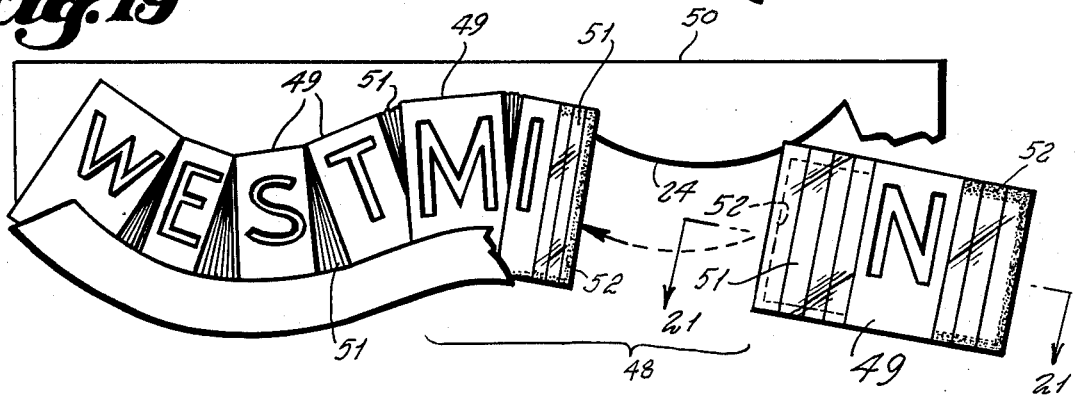
FIG. 19 is a fragmentary front view of a carrier and stencils used to do the printing shown in FIG. 18.
Figure 20:
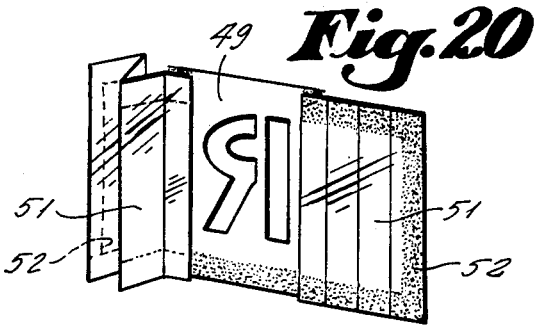
FIG. 20 is an enlarged perspective view of one of the stencils shown in FIG. 19.
Figure 21:
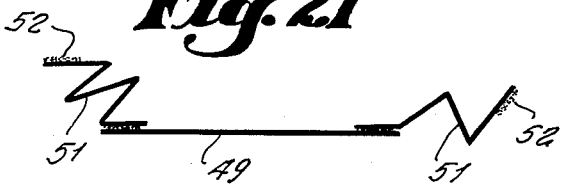
FIG. 21 is a view in direction 21—21 of FIG. 19.

In FIG. 18 yet another shape of printed name 34 is shown on a T-shirt, and which is along a line extending in both upward and downward curves that are along arcs that may be made either the same, different or even elliptically varying in radial arm length. This is accomplished by a kit 48 having stencils 49 and a carrier 50; the contour of the name being determined by the shape of the carrier opening 24. Each stencil is made of the usual rectangular paper sheet, described above, and includes a flap 51 attached to each opposite side edge thereof; the flaps being made of thin polyethylene film or other equivalent material so to be flexible. The outward end side edge of each flap is attachable by means of pressure sensitive adhesive 52 to the correspondingly outer edge of an adjacent stencil flap. Accordingly, flaps along a left side of a stencil have the adhesive on a rear side thereof so to mate with the adhesive on a front side of flaps attached to the right side of the stencils, as shown in FIG. 19, so to be readily and firmly held together and form a seal preventing ink to seep therebetween. Also, as shown in the same figure, the flap adhesives may be made extended along the full upper and lower edges of the flaps so when closely grouped, they adhere together and not accidentally protrude in front of any stencil cutout, blocking the printing.

Figure 22:
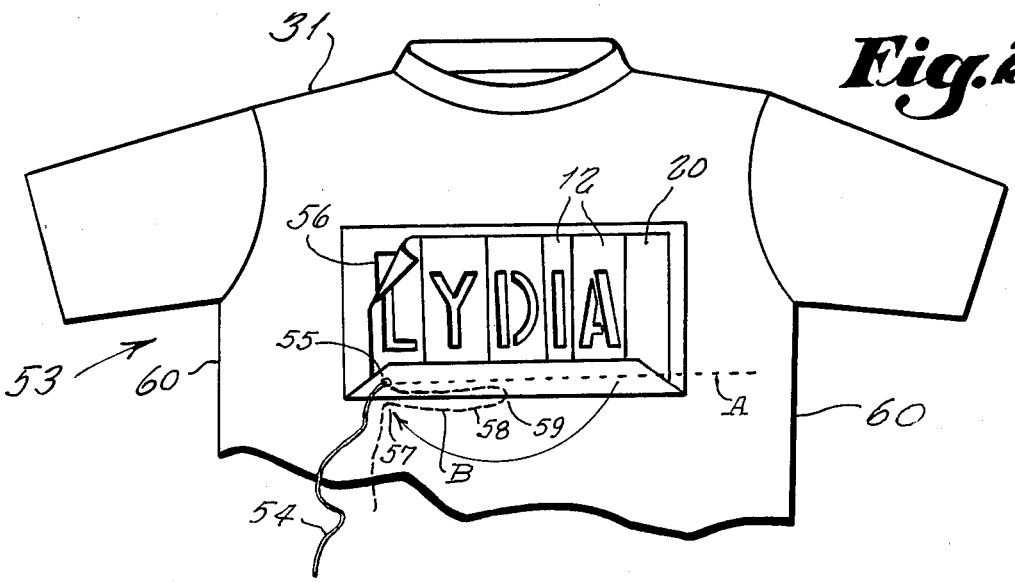
FIG. 22 is a front view of another design of the invention which includes means for centering a printing on a T-shirt.

Manufacturers of T-shirts and interlock fabric goods generally cut their required pieces so as to leave on a front side thereof a built-in vertical center line, such as a fold, and printers use it as a guide for centralizing their printing upon the garment. However, such guide line is not always provided on fleecewear goods, such as sweatshirts or other textile products. FIG. 22 accordingly illustrates yet another form 53 of the invention wherein a carrier additionally includes a quick means for centering a printing job on a sweatshirt without need of any extra measuring device and the chance of making an inaccurate calculation. Here the carrier has one end of a string 54 attached by its one end to the carrier at a location 55 that aligns with one end edge 56 of the carrier opening 24. When the carrier is loaded either with a longer or shorter row of stencils, the name formed by the stencils can be quickly aligned to bridge symetrically across the center of the shirt. The stencils are loaded on the carrier starting at end edge 56, and blank spacers 20 fill up the leftover opposite end of the word (as shown by dotted lines at A), and a point 57 of the string at the word end is then brought back (as indicated by the arrow) to adjacent the location 55 to form a loop 58 (as shown by the broken line at B), which when pulled taut locates a loop end 59 which is then aligned with the center of the T-shirt, midway between the opposite side edges 60 of the shirt.

It will be readily apparent that rows of alphabetical or numerical characters, other than the straight or arched rows presented here, such as angled, spiralled or the like, can also be accomplished with the principals of this invention.

FIG. 23 illustrates yet one more form 62 of the invention wherein the carrier is adapted to hold two rows of stencils for printing two rows of text, such as a two-line phrase upon a banner, poster, T-shirt or the like. In this design, the carrier includes two openings 24 separated by a cross strip 63 left therebetween. When the upper opening 24 is punched out, a tab 64 is left remaining along its lower edge; the tab subsequently being bent double over a top of the cross strip so as to form a pocket 65 for receiving the lower edges of the upper row of stencils, and also a pocket 66 for receiving the upper edges of the lower row of stencils, both of which are options for use by the printer. Additionally, the carrier of FIG. 23 also includes a folded tab 67 along its upper end so as to form a pocket 68 for receiving the upper edges of the upper row of stencils. Accordingly, the stencils include a pressure sensitive adhesive along an upper edge rear side thereof as shown at 69 for being adhered inside the pocket 68. Thus each stencil has adhesive on both upper and lower edges, which alternately permits the upper and lower stencils to be adhered directly to each other, as shown at 70 so as to eliminate use of the cross strip pockets 65 and 66 if desired. The stencils 12 may additionally include calibrations 29a along their upper and lower edges, as shown in FIG. 23; the calibrations being aligned with the side edges of the stencil cutouts 19 so to aid in positioning the stencils adjacent each other quickly and accurately while providing equal spacing between letters or numerals with maximum overlap as well as not covering any of the stencil openings. The carrier has numbered calibrations 71 along all pocket edges for alignment purposes. The cross strip 63 is shown located midway between the parallel lower and upper pockets 27 and 68 of the carrier so that same height stencils are received to print two rows of same height letters. However, the carrier may be made without the cross strip at a midway location so as to print two rows of letters that are different in height. Alternately the carrier may be made without a cross strip and the two rows of stencils adhered to each other, as mentioned above, may be of any height as long as they fit in the carrier and cover the entire single opening 24. In still another design the side edge strips of the carrier may be made adjustable in vertical length by means of numbered accordian pleats and adhesive applied thereupon to fit various heights of two-line stencil combinations.

The use of paper sheet material for making the stencils and carriers is ideal because its slight absorption quality is a necessary characteristic for creating crisp silk screened images. The thin paper maintains the contours of the stencil cutout when used between the framed screen mesh and the T-shirt surface while its cost effectiveness for disposable kit components cannot be overlooked.

While various other changes may be made in the detail construction, it is understood that such changes will be within the spirit and scope of the present invention as is defined by the appended claims.

What I claim as new, is:

1. A kit for individualized silk screen printing comprising, in combination, a plurality of stencils, a plurality of carriers each supporting several of said stencils assembled in a row during a printing process, a plurality of masks each shielding around a printing area during said process and a mesh-fitted screen printing frame for performing said process; each said stencil comprising a paper sheet having a central cutout, and a pressure sensitive adhesive on one side of said stencil for mounting upon one of said carriers; each said carrier comprising a paper sheet having at least one pocket along one edge thereof receiving one end of said stencils; and said pocket being formed by a folded-over tab along a fold line of said paper.

2. The combination as set forth in claim 1 wherein an end edge of said stencil end that is received in said pocket abuts against a bottom of said pocket.

3. The combination as set forth in claim 2 wherein said fold line is parallel to and spaced equidistant from said carrier window opening and from said cutouts of said row of stencils.

4. The combination as set forth in claim 3, wherein a plurality of said window openings in said carrier each aligns with a plurality of said stencil cutouts, and a plurality of said pockets are each formed along one of a plurality of said carrier edges and along an edge of a cross strip between said window openings.

5. The combination as set forth in claim 4, wherein said cross strip includes a "Z" shaped doublebent tab along one edge forming a pocket on each opposite side thereof.

6. The combination as set forth in claim 5, wherein a means for centralizing a printing on said printing area comprises a string of approximately a length of said carrier central opening, and one end of said string being attached to said carrier at a location aligned with a typical position of a left endmost edge of a cutout of a left endmost stencil supported on said carrier.

7. The combination as set forth in claim 3, wherein a singular central window opening on said carrier aligns with all said stencil cutouts.

8. The combination as set forth in claim 7, wherein each said mask comprises a large paper sheet having a singular central window opening aligned with said carrier window opening and said stencil cutouts.

9. The combination as set forth in claim 8, wherein said fold line of said carrier is straight, and said stencils are rectangular having side edges thereof overlapping side edges of adjacent said stencils.

10. The combination as set forth in claim 8, wherein said fold line of said carrier is curved and side edges of said stencils are diagonally inclined, overlapping side edges of adjacent said stencils.

11. The combination as set forth in claim 8 wherein said fold line is variably curved and said stencil side edges include adjustment means for overlap between adjacent said stencils.

* * * * *